US010895181B2

(12) United States Patent
Ahn

(10) Patent No.: US 10,895,181 B2
(45) Date of Patent: Jan. 19, 2021

(54) VEHICLE MUFFLER

(71) Applicants: Hyundai Motor Company, Seoul (KR); Kia Motors Corp., Seoul (KR)

(72) Inventor: Hyeon Gyun Ahn, Seoul (KR)

(73) Assignees: Hyundai Motor Company, Seoul (KR); Kia Motors Corp., Seoul (KR)

( * ) Notice: Subject to any disclaimer, the term of this patent is extended or adjusted under 35 U.S.C. 154(b) by 453 days.

(21) Appl. No.: 16/033,619

(22) Filed: Jul. 12, 2018

(65) Prior Publication Data

US 2019/0301323 A1 Oct. 3, 2019

(30) Foreign Application Priority Data

Mar. 29, 2018 (KR) ..... 10-2018-0036268

(51) Int. Cl.
*F01N 1/08* (2006.01)
*F01N 1/24* (2006.01)

(52) U.S. Cl.
CPC ..... *F01N 1/083* (2013.01); *F01N 1/24* (2013.01); *F01N 2470/02* (2013.01); *F01N 2470/14* (2013.01); *F01N 2490/02* (2013.01)

(58) Field of Classification Search
CPC ..... F01N 2470/14; F01N 2470/02; F01N 2490/02; F01N 2490/06; F01N 1/083; F01N 1/084; F01N 1/089; F01N 1/24; F01N 1/161; F01N 1/163; F01N 1/165; F01N 1/166
See application file for complete search history.

(56) References Cited

U.S. PATENT DOCUMENTS 4,913,260 A * 4/1990 Fallon ..... F01N 1/166 181/254
5,025,890 A * 6/1991 Hisashige ..... F01N 1/02 181/256
5,614,699 A * 3/1997 Yashiro ..... F01N 1/02 181/254
5,723,827 A 3/1998 Sasaki et al.
5,739,483 A 4/1998 Yashiro et al.
(Continued)

FOREIGN PATENT DOCUMENTS

JP 2001-263039 A 9/2001
JP 2006-233862 A 9/2006
(Continued)

*Primary Examiner* — Jeremy A Luks
(74) *Attorney, Agent, or Firm* — Morgan, Lewis & Bockius LLP

(57) ABSTRACT

A vehicle muffler may include first to third baffles to partition the internal to a housing into first to fourth chambers; a suction tube penetrating the housing, the first to third baffles in series, having an inlet at outside of the housing and an outlet in the fourth chamber, and having through-holes in the section locating in the first to third chambers; a first discharge tube penetrating the first and second baffles and the housing in series, having an inlet on the first baffle, and an outlet at outside of the housing; a second discharge tube penetrating the second and third baffles, and the housing in series, having an inlet in the second chamber, and an outlet at the outside of the housing; and a connection tube penetrating the second and third baffles in series, having an inlet in the second chamber, and an outlet in the fourth chamber.

12 Claims, 5 Drawing Sheets

(56) References Cited

U.S. PATENT DOCUMENTS

| | | | | |
|---|---|---|---|---|
| 5,929,398 | A * | 7/1999 | Amino | F01N 1/089 181/228 |
| 7,004,283 | B2 | 2/2006 | Wörner et al. | |
| 7,426,979 | B2 * | 9/2008 | Nagai | F01N 1/166 137/527.4 |
| 7,506,723 | B2 * | 3/2009 | Hoerr | F01N 1/003 181/250 |
| 7,712,578 | B2 * | 5/2010 | Han | F01N 1/084 181/272 |
| 7,967,107 | B2 * | 6/2011 | Han | F01N 1/084 181/254 |
| 8,172,039 | B2 * | 5/2012 | Park | F01N 1/10 181/256 |
| 8,528,693 | B1 * | 9/2013 | Park | F01N 1/083 181/268 |
| 8,636,103 | B1 * | 1/2014 | Won | F01N 1/083 181/256 |
| 9,010,486 | B2 * | 4/2015 | Andre | F01N 13/1888 181/268 |
| 9,695,719 | B2 * | 7/2017 | Arai | F01N 1/166 |
| 9,752,475 | B2 * | 9/2017 | Peters | F01N 1/168 |
| 2009/0000282 | A1 * | 1/2009 | Gruber | F01N 1/084 60/299 |
| 2011/0126531 | A1 * | 6/2011 | Kye | F01N 1/163 60/324 |

FOREIGN PATENT DOCUMENTS

| | | | |
|---|---|---|---|
| KR | 10-1997-0027664 | A | 6/1997 |
| KR | 10-2013-0064299 | A | 6/2013 |

* cited by examiner (A–A)

(B–B)

(C–C)

VEHICLE MUFFLER

CROSS REFERENCE TO RELATED APPLICATION

The present application claims priority to Korean Patent Application No. 10-2018-0036268 filed on Mar. 29, 2018, the entire contents of which is incorporated herein for all purposes by this reference.

BACKGROUND OF THE DISCLOSURE

Field of the Disclosure

The present invention relates to a vehicle muffler provided for implementing sporty exhaust sound quality.

Description of Related Art

An exhaust gas discharged upon engine operation of a vehicle passes through a catalytic device configured for purifying harmful components of human body such as carbon monoxide and nitrogen compounds, and then is delivered to a silencer through an exhaust system.

The silencer (muffler), as a device configured for reducing exhaust noise of the exhaust gas discharged by a vehicle, lowers the temperature and pressure of the exhaust gas, thus reducing the exhaust noise.

An internal space of the muffler is partitioned into several chambers by a plurality of baffle plates to enhance the damping effect of exhaust noise, and the noise of the exhaust gas is gradually reduced due to the interference of the sound waves, the reduction in the pressure fluctuation, the reduction in the exhaust temperature, etc. in a process of passing through the space of these chambers.

Furthermore, the sound quality during exhaust may be variously adjusted by the muffler. The sound quality of an exhaust system generated in a sedan vehicle is referred to as limousine exhaust sound quality, and the sound quality of an exhaust system generated in a sports vehicle or a coupe vehicle is referred to as sporty exhaust sound quality.

A vehicle with a manual transmission specification is tuned to an engine, a suspension, and a steering system so that a driver feels the agile and dynamic driving feeling while controlling the transmission himself. In the present time, it is preferable to implement sporty exhaust sound to stimulate the auditory sensibility that matches the driving pattern rather than the quietness in the exhaust system.

To implement the sporty exhaust sound quality, it is designed in the direction increasing the exhaust generation sound (booming) of the muffler.

To achieve the sporty exhaust sound quality, the strengthening of the exhaust booming of the muffler enhances the exhaust booming in a high RPM region of 4,000~5,000 RPM (Revolutions Per Minute) thus achieving the sporty exhaust sound quality, while in a low RPM region of 2,000~3,000 RPM (Revolutions Per Minute), there is a problem in that the internal noise deteriorates due to the enhanced exhaust booming and the quietness of the vehicle is reduced.

However, in the manual transmission vehicle, the frequency that a driver operates the vehicle at a low RPM in a high gear stage is few, and the burden on the booming sound at a low RPM is small because there are many driving patterns that pass rapidly through a low RPM range (1,200 to 1,400 RPM). Therefore, there is the demand for a muffler for the manual transmission vehicle that achieves the sporty exhaust sound at the low RPM while securing the driving responsiveness corresponding thereto.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a vehicle muffler of a low backpressure for increasing its output while implementing sporty exhaust sound suitable for a manual transmission vehicle.

A vehicle muffler in accordance with various aspects of the present invention for achieving the object may include a first baffle, a second baffle, and a third baffle disposed in turn to partition the internal to a housing into a first chamber, a second chamber, a third chamber, and a fourth chamber along the width direction thereof; a suction tube disposed to penetrate the housing, the first baffle, the second baffle, and the third baffle in turn, having an inlet located at the outside of the housing, having an outlet located in the fourth chamber, and formed with a plurality of through-holes in a section locating in the first chamber, the second chamber, and the third chamber; a first discharge tube disposed to penetrate the first baffle, the second baffle, and the housing in turn, having an inlet located on the first baffle, and having an outlet located at the outside of the housing; a second discharge tube disposed to penetrate the second baffle, the third baffle, and the housing in turn, having an inlet located in the second chamber, and having an outlet located at the outside of the housing; and a connection tube disposed to penetrate the second baffle and the third baffle in turn, having an inlet located in the second chamber, and having an outlet located in the fourth chamber.

The housing may be provided to have one side surface in the longitudinal direction penetrated by the inlet of the suction tube, and to have the other side surface in the longitudinal direction penetrated by the outlet of the first discharge tube and the outlet of the second discharge tube, respectively.

The suction tube may include a first straight section extending along the longitudinal direction of the housing in the first chamber, a bending section extending from the first straight section and bent toward the first baffle side, and a second straight section extending from the bending section along the width direction of the housing to penetrate the first baffle, the second baffle, and the third baffle.

A plurality of through-holes may be formed in the first straight section of the suction tube, and a plurality of through-holes may be formed in the section locating in the second chamber and the third chamber of the second straight section, respectively.

The first baffle and the second baffle may be formed with a plurality of connection holes.

The vehicle muffler can further include a cap sealing by blocking the outlet of the suction tube.

A sound absorption material may be filled in the third chamber.

The first baffle can have the suction tube and the first discharge tube penetrated on a middle portion thereof, and have the plurality of connection holes formed at both sides thereof based on the middle portion, respectively; and the second baffle can have the suction tube and the first discharge tube penetrated on a middle portion, have the second discharge tube penetrated at one side thereof based on the middle portion, and have the plurality of connection holes formed at the other side thereof.

The first discharge tube may be provided so that the plurality of through-holes are formed in the section locating in the second chamber.

According to the vehicle muffler including the above-described structure, it is possible to achieve the sporty exhaust sound suitable for the manual transmission vehicle, and to enhance the driving performance to ultimately improve the commerciality of the vehicle by reducing the backpressure.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
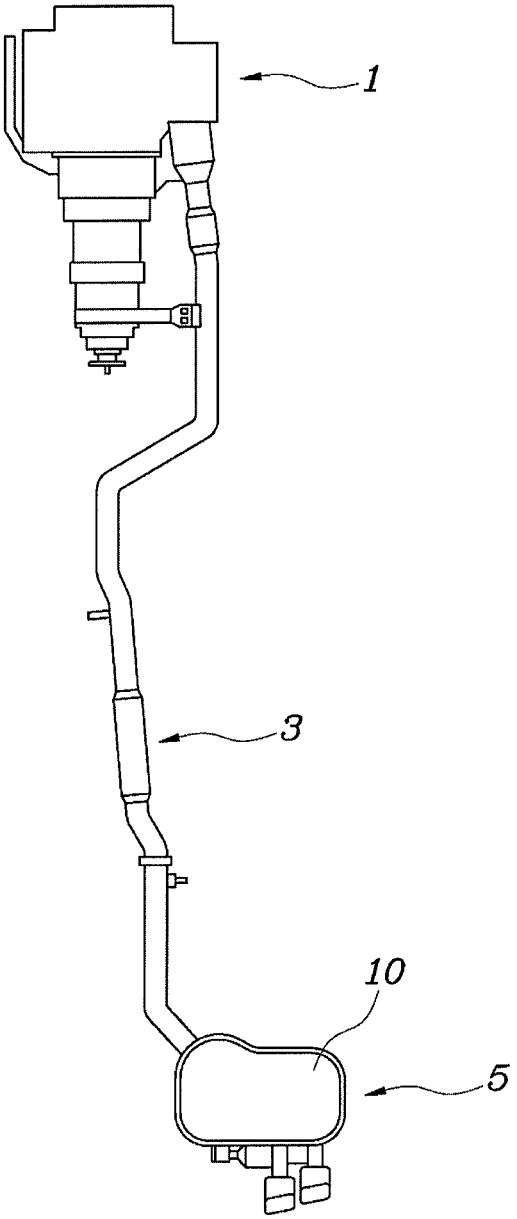
FIG. 1 is a diagram illustrating an exhaust system for a vehicle in accordance with an exemplary embodiment of the present invention.

It may be understood that the appended drawings are not necessarily to scale, presenting a somewhat simplified representation of various features illustrative of the basic principles of the invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION OF THE DISCLOSURE

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the other hand, the invention(s) is/are intended to cover not only the exemplary embodiments, but also various alternatives, modifications, equivalents and other embodiments, which may be included within the spirit and scope of the invention as defined by the appended claims.

Specific structural and functional descriptions of the exemplary embodiments of the present invention included in the specification or application are only for illustrating the exemplary embodiments of the present invention, and the exemplary embodiments in accordance with various aspects of the present invention may be embodied in various forms and should not be construed as limited to the exemplary embodiments set forth in the specification or application.

Various modifications and various forms may be made in the exemplary embodiments in accordance with various aspects of the present invention, so that specific embodiments are illustrated in the drawings and described in detail in the specification or application. It should be understood, however, that it is not intended to limit the exemplary embodiments in accordance with the concepts of the present invention to the disclosed forms, but includes all modifications, equivalents, and alternatives falling within the spirit and technical scope of the present invention.

The terms "first" and/or "second," and the like are used to illustrate various components, but the components should not be limited by the terms. The terms are used to differentiate one element from another, for example, a first component may be referred to as a second component, and similarly, the second component may be also referred to as the first component without departing from claims in accordance with the concepts of the present invention.

It will be understood that when an element is referred to as being "connected" or "coupled" to another element, it may be "directly connected" or "coupled" to the other element, but also to the other element with other elements interposed therebetween. On the other hand, it should be understood that any configuration element has no other element in between the time stated that "directly connected" or "directly coupled" to another element. Other expressions that describe the relationship between elements, such as "between" and "directly between" or "adjacent to" and "directly adjacent to" should be interpreted as well.

The terminology used the specification is for describing various exemplary embodiments only and is not intended to limit the present invention. The singular forms are intended to include the plural forms as well, unless the context clearly indicates otherwise. In the specification, It will be further understood that the terms "comprises" or "includes," and the like specify the presence of stated features, integers, steps, operations, elements, components or combination thereof, but do not preclude the presence or addition of one or more other features, integers, steps, operations, elements, components, or combination thereof.

Unless otherwise defined, all terms including technical and scientific terms used herein have the same meaning as commonly understood by one of ordinary skill in the art to which the present invention belongs. It will be further understood that terms, such as those defined in commonly used dictionaries, should be additionally interpreted as having a meaning which is consistent with their meaning in the context of the relevant art, and will not be interpreted in an idealized or overly formal sense unless expressly so defined in the specification.

Hereinafter, a vehicle muffler in accordance with the exemplary embodiments of the present invention will be described with reference to the accompanying drawings.

FIG. 1 is a diagram illustrating an exhaust system for a vehicle in accordance with an exemplary embodiment of the present invention. Referring to FIG. 1, a vehicle muffler 5 is provided to receive an exhaust gas from an exhaust pipe, and the exhaust gas discharged from an engine 1 is delivered to the vehicle muffler 5 through an auxiliary muffler 3. The auxiliary muffler 3 and the vehicle muffler 5 lower the temperature and pressure of the exhaust gas, and reduce exhaust sound while causing the sound wave interference.

Figure 2:
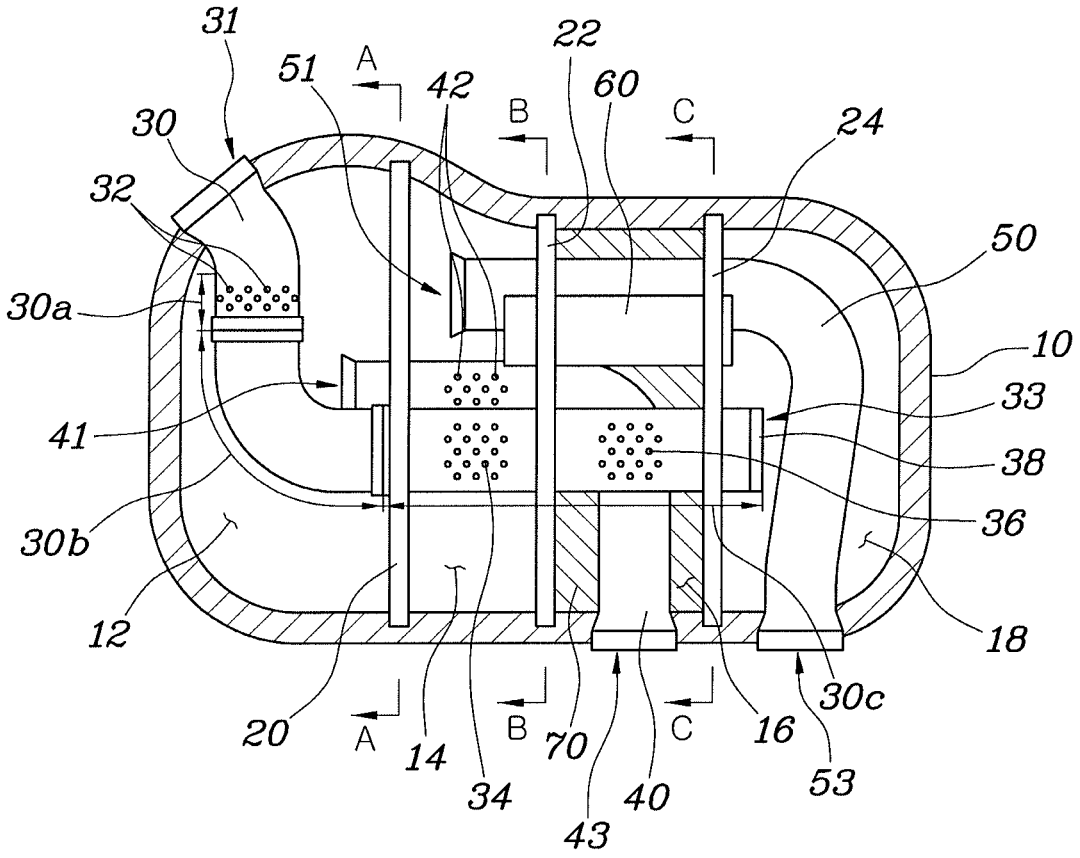
FIG. 2 is a diagram illustrating the internal to the vehicle muffler in accordance with the exemplary embodiment of the present invention.

FIG. 2 is a diagram illustrating the internal to the vehicle muffler in accordance with the exemplary embodiment of the present invention.

Referring to FIG. 2, the vehicle muffler in accordance with various aspects of the present invention may include a first baffle 20, a second baffle 22, and a third baffle 24 disposed in turn to partition the internal to a housing 10 into a first chamber 12, a second chamber 14, a third chamber 16, and a fourth chamber 18 along the longitudinal direction of the housing 10; a suction tube 30 disposed to penetrate the housing 10, the first baffle 20, the second baffle 22, and the third baffle 24 in turn, having an inlet 31 located at the outside of the housing 10, having an outlet 33 located in the fourth chamber 18, and formed with a plurality of through-holes 32, 34, 36 in the section locating in the first chamber 12, the second chamber 14, and the third chamber 16; a first discharge tube 40 disposed to penetrate the first baffle 20, the second baffle 22, and the housing 10 in turn, having an inlet 41 located on the first baffle 20, and having an outlet 43 located at the outside of the housing 10; a second discharge tube 50 disposed to penetrate the second baffle 22, the third baffle 24, and the housing 10 in turn, having an inlet 51 located in the second chamber 14, and having an outlet 53 located at the outside of the housing 10; and a connection tube 60 disposed to penetrate the second baffle 22 and the third baffle 24 in turn, having an inlet located in the second chamber 14, and having an outlet located in the fourth chamber 18.

That is, the internal space of the housing 10 is partitioned into the first, second, third and fourth chambers 12, 14, 16, 18 along the longitudinal direction of the housing 10 by the first, second, and third baffles 20, 22, 24.

The suction tube 30 receives an exhaust gas from an engine to discharge it to the internal to the housing 10. For the present purpose, the inlet of the suction tube 30 is connected to an exhaust pipe provided in the outside of the housing 10 to receive the exhaust gas from the engine.

The suction tube 30 is provided to penetrate all of the first, second, and third baffles 20, 22, 24, and to be formed with a plurality of through-holes 32, 34, 36 in the section locating in the first, second, and third chambers 12, 14, 16 to deliver the exhaust gas received from the engine to each chamber of the internal to the housing 10.

Meanwhile, the vehicle muffler in accordance with various aspects of the present invention is provided with first and second discharge tubes 40, 50 to discharge the exhaust gas supplied to the internal to the housing 10 to the outside.

The first discharge tube 40 is provided to have an inlet located in the first chamber 12, to penetrate the first and second baffles 20, 22 in turn and then to penetrate the housing 10 to have an outlet formed at the outside of the housing 10 through the housing 10, thus discharging the exhaust gas. Accordingly, the first discharge tube 40 discharges the exhaust gas moving in the first chamber 12 to the outside of the housing 10.

The second discharge tube 50 is provided to have an inlet located in the second chamber 14, and to have an outlet formed at the outside of the housing 10 to penetrate the second baffle 22 and the housing 10 in turn. That is, the second discharge tube 50 is provided to discharge the exhaust gas moving in the second chamber 14 to the outside of the housing 10.

Meanwhile, the vehicle muffler in accordance with various aspects of the present invention is further provided with a connection tube 60 connecting the second chamber 14 and the fourth chamber 18 by penetrating the second and third baffles 22, 24 in turn. That is, the connection tube 60 delivers the exhaust gas moving in the second chamber 14 to the fourth chamber 18 which is a resonance chamber, thus effectively reducing the booming sound which is the exhaust noise.

Thus, the vehicle muffler receives the exhaust gas from the engine to induce so that it flows in various shapes in the plurality of chambers provided in the internal to the housing 10, thus reducing the exhaust sound due to the sound wave interference, the pressure of the exhaust gas, and the reduction in the temperature.

In an exemplary embodiment of the present invention, the suction tube 30, the first and second discharge tubes 40, 50, and the connection tube 60 may be provided to be press-fitted by penetrating at least two baffles of the first, second, and third baffles 20, 22, 24, to be fixed to the internal to the housing 10 even without mounting a separate fixture.

In an exemplary embodiment of the present invention, the housing 10 may be provided to have one side surface in the longitudinal direction penetrated by the inlet of the suction tube 30, and the other side surface in the longitudinal direction penetrated by the outlet of the first discharge tube 40 and the outlet of the second discharge tube 50, respectively.

Herein, the width direction of the housing 10, as the direction perpendicular to the longitudinal direction of the housing 10, means the direction perpendicular to the longitudinal axis of the housing 10.

A convention main muffler is provided so that the exhaust gas flows at both end portions in the longitudinal direction of the housing 10 and a plurality of chambers are disposed along the longitudinal direction thereof, while the present invention is provided so that the direction that the chambers are disposed and the direction that the exhaust gas flows into the housing are perpendicular to each other, thus reducing the volume of the housing 10.

Furthermore, the suction tube 30 may include a first straight section 30*a* extending along the longitudinal direction of the housing 10 in the first chamber 12, a bending section 30*b* extending from the first straight section 30*a* to be bent toward the first baffle 20, and a second straight section 30*c* extending from the bending section 30*b* along the longitudinal direction of the housing 10 to penetrate the first baffle 20, the second baffle 22, and the third baffle 24.

That is, as described above, since a plurality of chambers are disposed along the longitudinal direction inside the housing 10 and the exhaust gas flows into one side surface and the other side surface in the width direction of the housing 10, respectively, the suction tube 30 needs to be bent to penetrate the first, second, and third baffles 20, 22, 24.

The suction tube 30 may be produced as an integral tube by integrating the regions corresponded to the first straight section 30*a*, the bending section 30*b*, and the second straight section 30*c*, and may be also provided to assemble after the parts are produced, respectively considering the production convenience.

Herein, a plurality of through-holes 32 are formed in the first straight section 30*a* of the suction tube 30, and a plurality of through-holes 34, 36 may be formed in the section locating in the second chamber 14 and the third chamber 16 of the second straight section 30*c*, respectively.

That is, if the suction tube 30 includes a plurality of parts, it may be provided so that the plurality of through-holes 32, 34, 36 are formed in the straight section.

Herein, the number of through-holes formed in the first straight section 30*a* may be set less than the number of through-holes formed in the second straight section 30*c*. Accordingly, in the low RPM condition, the phenomenon that the exhaust gas is excessively discharged to the first chamber 12 side may be prevented, and a detailed description thereof will be made later.

Figure 3:
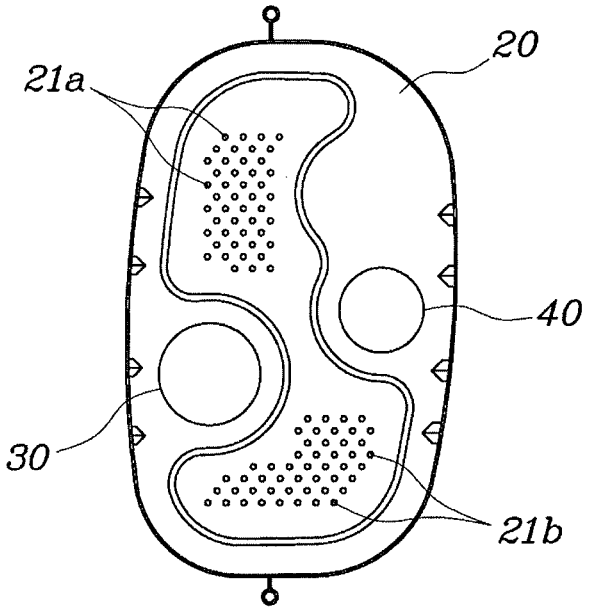
FIG. 3 is a cross-sectional diagram illustrating the A-A cross section of FIG. 2.
Figure 4:
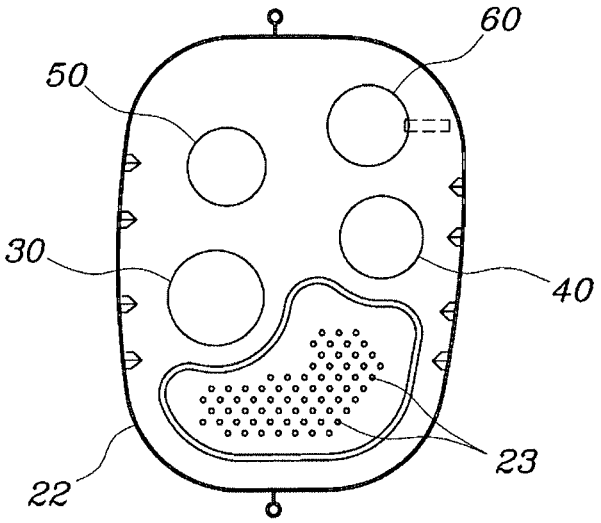
FIG. 4 is a cross-sectional diagram illustrating the B-B cross section of FIG. 2.
Figure 5:
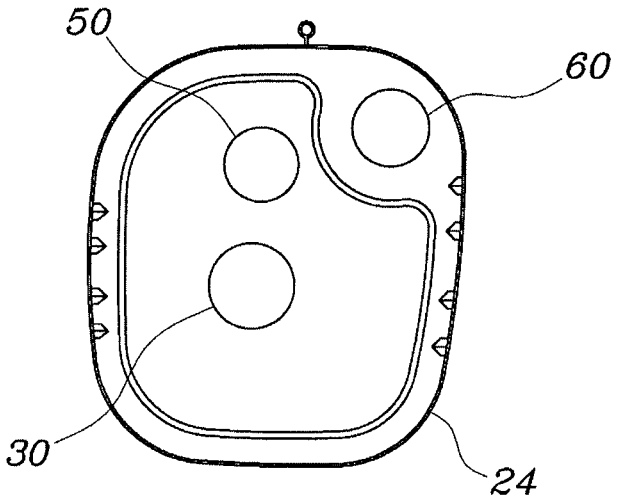
FIG. 5 is a cross-sectional diagram illustrating the C-C cross section of FIG. 2.

Meanwhile, FIG. 3 is a cross-sectional diagram illustrating the A-A cross section of FIG. 2, FIG. 4 is a cross-sectional diagram illustrating the B-B cross section of FIG. 2, and FIG. 5 is a cross-sectional diagram illustrating the C-C cross section of FIG. 2.

Referring to FIG. 3, FIG. 4, and FIG. 5, the first baffle 20 and the second baffle 22 in accordance with various aspects of the present invention may be formed with a plurality of connection holes 21*a*, 21*b*, 23.

That is, the connection holes 21*a*, 21*b* may be formed on the first baffle 20 to connect the first chamber 12 and the second chamber 14 each other, and the connection hole 23 may be formed on the second baffle 22 to connect the second chamber 14 and the third chamber 16 each other.

Accordingly, the exhaust gas flowed into the first, second, and third chambers 12, 14, 16 may be flowed into different chambers through the connection holes 21*a*, 21*b*, 23. In the flow process, the speed, temperature, and pressure of the exhaust gas are reduced, thus reducing the exhaust noise.

Meanwhile, the vehicle muffler in accordance with various aspects of the present invention may further include a cap 38 sealing by blocking the outlet of the suction tube 30.

As described above, the suction tube 30 is provided to receive the exhaust gas from the engine through the inlet thereof, to deliver the exhaust gas to the first, second, and third chambers 12, 14, 16 through the plurality of through-holes 32, 34, 36 formed on the external circumferential surface thereof, and to have the outlet located in the fourth chamber 18; and by allowing the cap 38 to block the outlet of the suction tube 30, it is possible to prevent the exhaust gas from being supplied to the fourth chamber 18 through the suction tube 30.

Accordingly, since the fourth chamber 18 can receive the exhaust gas only through the connection tube 60, the fourth chamber 18 can reduce the booming sound as a Helmholtz resonance chamber.

Furthermore, the exhaust gas flowing to the outlet along the suction tube 30 returns in the opposite direction thereof when meeting the cap 38, and in the present process, it is possible to reduce the temperature, pressure, and speed of the exhaust gas due to the interference with the exhaust gas which already has flowed in the forward direction thereof. As a result, the exhaust noise is reduced by the cap 38.

Furthermore, a sound absorption material 70 may be filled in the third chamber 16. That is, the exhaust gas flowing the suction tube 30 is discharged to the third chamber 16 through the through-hole 36 located in the third chamber 16, and by providing so that the sound absorption material 70 is filled the third chamber 16, thus effectively reducing the exhaust noise in the high RPM condition.

Furthermore, the exhaust gas flowing the second chamber 14 may be also flowed into the third chamber 16 through the connection hole 23 formed on the second baffle 22, and by providing the sound absorption material 70 in the third chamber 16, thus reducing the exhaust noise. Herein, a glass wool may be used as the sound absorption material.

Meanwhile, the first baffle 20 can have the suction tube 30 and the first discharge tube 40 penetrated on a middle portion thereof, and have the plurality of connection holes 21*a*, 21*b* formed at both sides thereof based on the middle portion, respectively; and the second baffle 22 can have the suction tube 30 and the first discharge tube 40 penetrated on a middle portion thereof, have the second discharge tube 50 penetrated at one side thereof based on the middle portion, and have the plurality of connection holes 23 formed at the other side thereof.

That is, the suction tube 30 discharges the exhaust gas to the first chamber 12 through the plurality of through-holes 32 provided in the first straight section 30*a*, and the exhaust gas supplied to the first chamber 12 is flowed into the first discharge tube 40, or may be flowed into the second chamber 14 through the plurality of connection holes 21*a*, 21*b* formed on the first baffle 20.

The first baffle 20 is formed with the plurality of connection holes 21*a*, 21*b* at both sides thereof, respectively, based on the middle portion thereof; and the second discharge tube 50 and the connection hole 23 are formed on the second baffle 22 to correspond to each point, thus providing so that the exhaust gas evenly flows into the second discharge tube 50 and the third chamber 16.

Furthermore, in an exemplary embodiment of the present invention, the first discharge tube 40 may be provided so that a plurality of through-holes 42 are formed in the section locating in the second chamber 14.

Accordingly, the first discharge tube 40 is provided to supply a portion of the exhaust gas to the second chamber 14 through the plurality of through-holes 42 even in the process that receives the exhaust gas from the first chamber 12 to discharge it to the outside of the housing 10, thus more reducing the exhaust noise.

Figure 6:
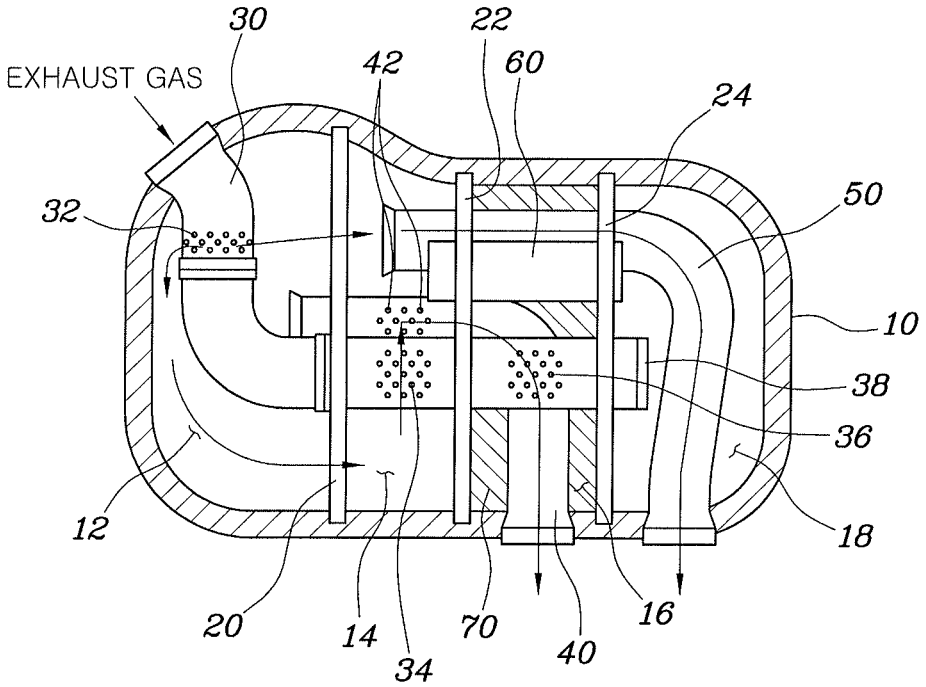
FIG. 6 is a diagram illustrating an exhaust gas flow in the vehicle muffler in a low speed/low RPM condition in accordance with the exemplary embodiment of the present invention.
Figure 7:
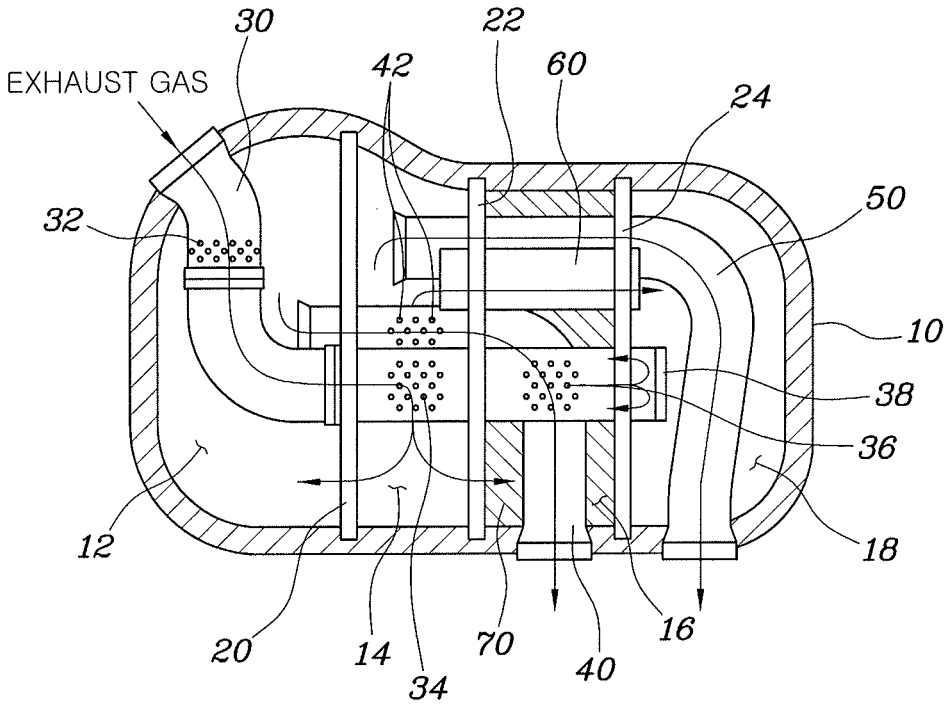
FIG. 7 is a diagram illustrating an exhaust gas flow in the vehicle muffler in a high speed/high RPM condition in accordance with the exemplary embodiment of the present invention.

FIG. 6 is a diagram illustrating an exhaust gas flow in the vehicle muffler in the low speed/low RPM condition in accordance with the exemplary embodiment of the present invention, and FIG. 7 is a diagram illustrating an exhaust gas flow in the vehicle muffler in the high speed/high RPM condition in accordance with the exemplary embodiment of the present invention.

Referring to FIG. 6, if the vehicle is the low speed/low RPM condition, the exhaust gas flowed into the suction tube 30 flows at a low speed, such that as illustrated by the arrows, it is mainly discharged into the first chamber 12 through the through-hole 32 formed in the first straight section 30*a*, or discharged into the second chamber 14 through the through-hole 34 formed in the second straight section 30*c* while flowing along the suction tube 30.

Herein, the exhaust gas supplied to the first discharge tube 40 is discharged to the outside of the housing 10 or supplied to the second chamber 14 through the plurality of through-holes 42.

The exhaust gas thus supplied to the first chamber 12 is mainly discharged to the first discharge tube 40, or discharged to the second chamber 14 through the connection hole formed on the first baffle 20. The exhaust gas thus supplied to the second chamber 14 is discharged to the outside of the housing 10 through the second discharge tube 50, or supplied to the first discharge tube 40 through the through-hole of the first discharge tube 40 and discharged to the outside of the housing 10.

The vehicle muffler in accordance with various aspects of the present invention is included as the configuration that the exhaust gas under the low speed and the low RPM condition is directly discharged to the outside of the housing 10 through the first discharge tube 40, thus enhancing the driving performance of the vehicle by reducing the backpressure of the exhaust gas even though it causes the damage in the reduction effect of the exhaust noise. Accordingly, it is possible to provide a sporty driving emotion required by a driver in the manual transmission vehicle, thus increasing the commerciality of the vehicle.

Meanwhile, referring to FIG. 7, if the vehicle is in the high speed/high RPM condition, the exhaust gas supplied to the suction tube 30 flows at a high speed, such that as illustrated by the arrows, it is mainly supplied to the second chamber 14 or the third chamber 16, or flows to the outlet of the suction tube 30. In the present time, the cap 38 causes the interference with the exhaust gas flow inside the suction tube 30 to reduce the speed, thus reducing the exhaust noise.

Furthermore, the exhaust gas supplied to the second chamber 14 is flowed into the first and third chambers 12, 16, respectively, through the connection hole formed on the first and second baffles 20, 22, or supplied to the second discharge tube 50 or the connection tube 60.

If the exhaust gas is supplied to the second chamber 14 through the suction tube 30 and then again supplied to the first chamber 12 through the connection hole of the first baffle 20, it is discharged to the outside of the housing 10 through the first discharge tube 40, and in the present process, the speed, pressure, and temperature of the exhaust gas is reduced, thus effectively reducing the exhaust noise.

Furthermore, the exhaust gas supplied to the second chamber 14 through the suction tube 30 is discharged to the outside of the housing 10 through the second discharge tube 50, or discharged to the third chamber 16 through the connection hole of the second baffle 22, thus reducing the exhaust noise by the sound absorption material 70.

In the process that the exhaust gas is supplied to the fourth chamber 18 through the connection tube 60, the exhaust noise is reduced by the Helmholtz effect.

According to the vehicle muffler including the above-described structure, it is possible to achieve the sporty exhaust sound suitable for the manual transmission vehicle, and to enhance the driving performance and ultimately the commerciality of the vehicle by reducing the backpressure in the vehicle driving condition of the low speed/low RPM.

Furthermore, it is not necessary to control by applying a separate variable valve, thus effectively reducing the cost and weight of the muffler.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A vehicle muffler, comprising:

a first baffle, a second baffle, and a third baffle disposed in series to partition an internal of a housing into a first chamber, a second chamber, a third chamber, and a fourth chamber along a longitudinal direction of the housing;

a suction tube disposed to penetrate the housing, the first baffle, the second baffle, and the third baffle in series, having an inlet located at an outside of the housing, having an outlet located in the fourth chamber, and formed with a first through-hole in a section of the suction tube located in the first chamber, a second through-hole in a section of the suction tube located in the second chamber, and a third through-hole in a section of the suction tube located in the third chamber;

a first discharge tube disposed to penetrate the first baffle, the second baffle, and the housing in series, having an inlet located in the first chamber, and having an outlet located at the outside of the housing;

a second discharge tube disposed to penetrate the second baffle, the third baffle, and the housing in series, having an inlet located in the second chamber, and having an outlet located at the outside of the housing; and a connection tube disposed to penetrate the second baffle and the third baffle in series, having an inlet located in the second chamber, and having an outlet located in the fourth chamber.

2. The vehicle muffler according to claim 1, wherein the first chamber is formed between the internal of the housing and the first baffle, the second chamber is formed between the first baffle and the second baffle, the third chamber is formed between the second baffle and the third baffle, and the fourth chamber is formed between the third baffle and the internal of the housing.

3. The vehicle muffler according to claim 1, wherein the first discharge tube is disposed to penetrate the first baffle and the second baffle along a longitudinal axis of the housing and bent to form a L-shape to have the outlet of the first discharge tube located at the outside of the housing.

4. The vehicle muffler according to claim 1, wherein the second discharge tube is disposed to penetrate the second baffle and the third baffle along a longitudinal axis of the housing and bent to form a L-shape to have the outlet of the second discharge tube located at the outside of the housing.

5. The vehicle muffler according to claim 1, wherein the housing is provided to have a first side surface in the width direction thereof penetrated by the inlet of the suction tube and to have a second side surface in the width direction thereof penetrated by the outlet of the first discharge tube and the outlet of the second discharge tube, respectively.

6. The vehicle muffler according to claim 5, wherein the suction tube includes a first straight section extending along a width direction of the housing in the first chamber, a bending section extending from the first straight section to be bent toward the first baffle, and a second straight section extending from the bending section along the longitudinal direction of the housing to penetrate the first baffle, the second baffle, and the third baffle in series.

7. The vehicle muffler according to claim 6, wherein the first through-hole is formed in the first straight section of the suction tube, and the second through-hole is formed in the second straight section locating in the second chamber and the third through-hole is in the second straight section locating in the third chamber.

8. The vehicle muffler according to claim 7, wherein the first baffle is formed with at least a first connection hole, and wherein the second baffle is formed with at least a second connection hole.

9. The vehicle muffler according to claim 8, further including a cap mounted at the outlet of the suction tube and sealing the outlet of the suction tube.

10. The vehicle muffler according to claim 8, wherein a sound absorption material is filled in the third chamber.

11. The vehicle muffler according to claim 8, wherein the first baffle has the suction tube and the first discharge tube penetrated at a middle portion of the first baffle, and the at least one first connection hole includes a plurality of connection hole formed at a first side and a second side of the first baffle based on the middle portion, respectively, and wherein the second baffle has the suction tube and the first discharge tube penetrated at a middle portion of the second baffle, has the second discharge tube penetrated at a first side of the second baffle based on the middle portion of the second baffle, and has a plurality of connection holes formed at a second side of the second baffle.

12. The vehicle muffler according, to claim 8, wherein the first discharge tube includes a plurality of through-holes formed in a section locating in the second chamber.

* * * * *